US006893059B2

(12) United States Patent
Shen

(10) Patent No.: US 6,893,059 B2
(45) Date of Patent: May 17, 2005

(54) CYLINDRICAL LOCK WITH IMPROVED RESISTANCE TO TORQUE

(76) Inventor: Mu-Lin Shen, No. 18, Gong-Yeh 3 Road, An-Nan District, Tainan (TW)

( * ) Notice: Subject to any disclaimer, the term of this patent is extended or adjusted under 35 U.S.C. 154(b) by 0 days.

(21) Appl. No.: 10/303,186

(22) Filed: Nov. 25, 2002

(65) Prior Publication Data

US 2004/0100105 A1 May 27, 2004

(51) Int. Cl.[7] ..... E05C 1/12
(52) U.S. Cl. ..... 292/169; 292/336.3; 292/348
(58) Field of Search ..... 292/169, 336.3, 292/348, 350, 356, 357; 70/224

(56) References Cited

U.S. PATENT DOCUMENTS

| | | | | | |
|---|---|---|---|---|---|
| 323,393 | A | * | 8/1885 | Bullard | 70/452 |
| 2,805,880 | A | * | 9/1957 | Brozek et al. | 292/357 |
| 2,810,600 | A | * | 10/1957 | Kendrick | 292/357 |
| 3,000,659 | A | * | 9/1961 | Schlage et al. | 292/337 |
| 3,035,432 | A | * | 5/1962 | De Vines | 70/216 |
| 3,107,113 | A | * | 10/1963 | Sconzo | 292/228 |
| 3,228,218 | A | * | 1/1966 | Wilson | 70/475 |
| 4,869,083 | A | * | 9/1989 | DeMarseilles et al. | 70/224 |
| 5,118,152 | A | * | 6/1992 | Lin | 292/356 |
| 5,141,269 | A | * | 8/1992 | Haq et al. | 292/169 |
| 5,149,155 | A | * | 9/1992 | Caeti et al. | 292/336.3 |
| 5,265,924 | A | * | 11/1993 | Kim | 292/336.3 |
| 5,409,278 | A | * | 4/1995 | Harcourt | 292/357 |
| 5,481,890 | A | * | 1/1996 | Millman | 70/224 |
| 5,490,700 | A | * | 2/1996 | Zuckerman | 292/357 |
| 5,516,163 | A | * | 5/1996 | Baker | 292/169 |
| 5,556,144 | A | * | 9/1996 | Lin | 292/336.3 |
| 5,564,760 | A | * | 10/1996 | Mader | 292/182 |
| 5,570,916 | A | * | 11/1996 | Mader | 292/336.3 |
| 5,590,555 | A | | 1/1997 | Kester et al. | |
| 5,593,193 | A | * | 1/1997 | Heim | 292/336.3 |
| 5,845,522 | A | | 12/1998 | Shen | |
| 5,934,122 | A | * | 8/1999 | Edwards et al. | 70/416 |
| 5,947,535 | A | * | 9/1999 | Baker | 292/165 |
| 5,983,683 | A | * | 11/1999 | Shen | 70/224 |
| 6,048,007 | A | * | 4/2000 | Shor | 292/348 |
| 6,364,383 | B1 | * | 4/2002 | Shen | 292/357 |
| 6,470,721 | B2 | * | 10/2002 | Ming | 70/224 |
| 6,532,629 | B2 | * | 3/2003 | Armstrong | 16/414 |
| 6,598,440 | B1 | * | 7/2003 | Armstrong | 70/472 |
| 6,619,710 | B1 | * | 9/2003 | Hwang | 292/336.3 |
| 6,745,602 | B2 | * | 6/2004 | Nakasone et al. | 70/224 |

FOREIGN PATENT DOCUMENTS

| | | | | | |
|---|---|---|---|---|---|
| GB | 2140492 | A | * | 11/1984 | E05C/13/00 |

* cited by examiner

*Primary Examiner*—Robert J. Sandy
*Assistant Examiner*—Thomas Ho
(74) *Attorney, Agent, or Firm*—Alan D. Kamrath; Nikolai & Mersereau, P.A.

(57) ABSTRACT

A cylindrical lock includes a lock main body mounted in a mounting hole of a door, an inside rose liner, an outside rose liner, and two mounting rods. The lock main body includes a hub having an inside hub and an outside hub. The hub including two diametrically disposed recessed portions extending along an axial direction of the hub. The inside rose liner is securely mounted around the inside hub and has two holes. The outside rose liner includes a central hole in threading engagement with the outside hub. The outside rose liner includes two engaging slots aligned with the holes of the inside rose liner. Each mounting rod includes a first end with a screw hole and a second end engaged in an associated one of the engaging slots of the outside rose liner. The mounting rods are respectively positioned in the recessed portions of the hub.

12 Claims, 6 Drawing Sheets

CYLINDRICAL LOCK WITH IMPROVED RESISTANCE TO TORQUE

BACKGROUND OF THE INVENTION

1. Field of the Invention

The present invention relates to a cylindrical lock with improved resistance to torque.

2. Description of the Related Art

FIGS. 1 and 2 of the drawings illustrate a conventional cylindrical lock with lever handles for people that are handicapped in hands or rely on wheelchairs. The cylindrical lock includes a lock main body 1 mounted in a mounting hole 91 of a door 9. The lock main body 1 includes a substantially cylindrical hub 11 comprised of an inside hub 111 and an outside hub 112. A transmission assembly 12 is mounted in the hub 11 and includes an inside spindle 121, an outside spindle 122, and a retractor 120. The inside hub 111 includes a sleeve portion 113 with two diametrically opposed chamfered faces 114. The outside hub 112 includes a sleeve portion 115 with an outer threading. An inside rose liner 13 is mounted around the sleeve portion 113 of the inside hub 111 and has a central hole 131 with two diametrically opposed rectilinear sections 132 for engaging with the chamfered faces 114 of the inside hub 111. An outside rose liner 14 is mounted around the sleeve portion 115 of the outside hub 112 and has an inner threading 141 for threadedly engaging with the outer threading of the sleeve portion 115 of the outside hub 112.

The cylindrical lock further includes a latch mechanism 2 attached to the lock main body 11, an inside rose 32, an outside rose 42, a lever type inside handle 31, and a lever type outside handle 41. The latch mechanism 2 includes a latch 21 operably connected to the retractor 120 mounted in the lock main body 1. The latch 21 is retracted when the retractor 120 is actuated. The inside rose 32 covers the inside rose liner 13 and abuts against an inner side of the door 9. The outside rose 42 covers the outside rose liner 14 and abuts against an outer side of the door 9. The inside handle 31 has an end connected to the outside spindle 121 to turn therewith. The outside handle 41 has an end connected to the outside spindle 122 to turn therewith. Turning of either handle 31, 41 causes movement of the retractor 120, which, in turn, retracts the latch 21 to thereby allow opening of the door 9.

In the above cylindrical lock, the inside rose liner 13 and the outside rose liner 14 are important elements for positioning. Two diametrically opposed mounting rods 15 project from a side of the outside rose liner 14 and each includes a screw hole 151 in a distal end thereof. The inside rose liner 13 includes two diametrically opposed holes 130. Two bolts 16 are respectively extended through the holes 130 of the inside rose liner 13, two positioning holes 92 in the door 9, and the screw holes 151 of the mounting rods 15 on the outside rose liner 14, thereby securing the lock main body 1 to the door 9.

The outside rose liner 14 can be turned and thus move along an axial direction via threading engagement between the outer threading of the sleeve portion 115 of the outside hub 112 and the inner threading 141 of the outside rose liner 14 until the lock main body 1 reaches a desired position corresponding to the thickness of the door 9. Thus, the retractor 120 is aligned with a tail portion of the latch 21.

The above cylindrical lock is simple in its positioning structure and thus can be manufactured at a low cost.

However, the torque generated as a result of pressing the inside handle 31 of lever type or the outside handle 41 of lever type is considerably greater than that generated on a knob type handle, and it was found that the inside rose liner 13 and the sleeve portion 113 of the inside hub 111 could not resist excessive torque resulting from excessive force applied to the lever type handle. As a result, the elements of the cylindrical lock are apt to be damaged.

SUMMARY OF THE INVENTION

An object of the present invention is to provide cylindrical lock with improved resistance to torque.

A cylindrical lock in accordance with the present invention comprises:

- a lock main body adapted to be mounted in a mounting hole of a door, the lock main body including a hub having an inside hub and an outside hub, the hub including two diametrically disposed recessed portions extending along an axial direction of the hub;
- an inside rose liner securely mounted around the inside hub, the inside rose liner including two holes;
- an outside rose liner including a central hole in threading engagement with the outside hub, the outside rose liner including two engaging slots aligned with the holes of the inside rose liner; and
- two mounting rods each including a first end with a screw hole and a second end engaged in an associated one of the engaging slots of the outside rose liner, the mounting rods being respectively positioned in the recessed portions of the hub.

Other objects, advantages, and novel features of the invention will become more apparent from the following detailed description when taken in conjunction with the accompanying drawings.

DETAILED DESCRIPTION OF THE PREFERRED EMBODIMENT

Figure 4:
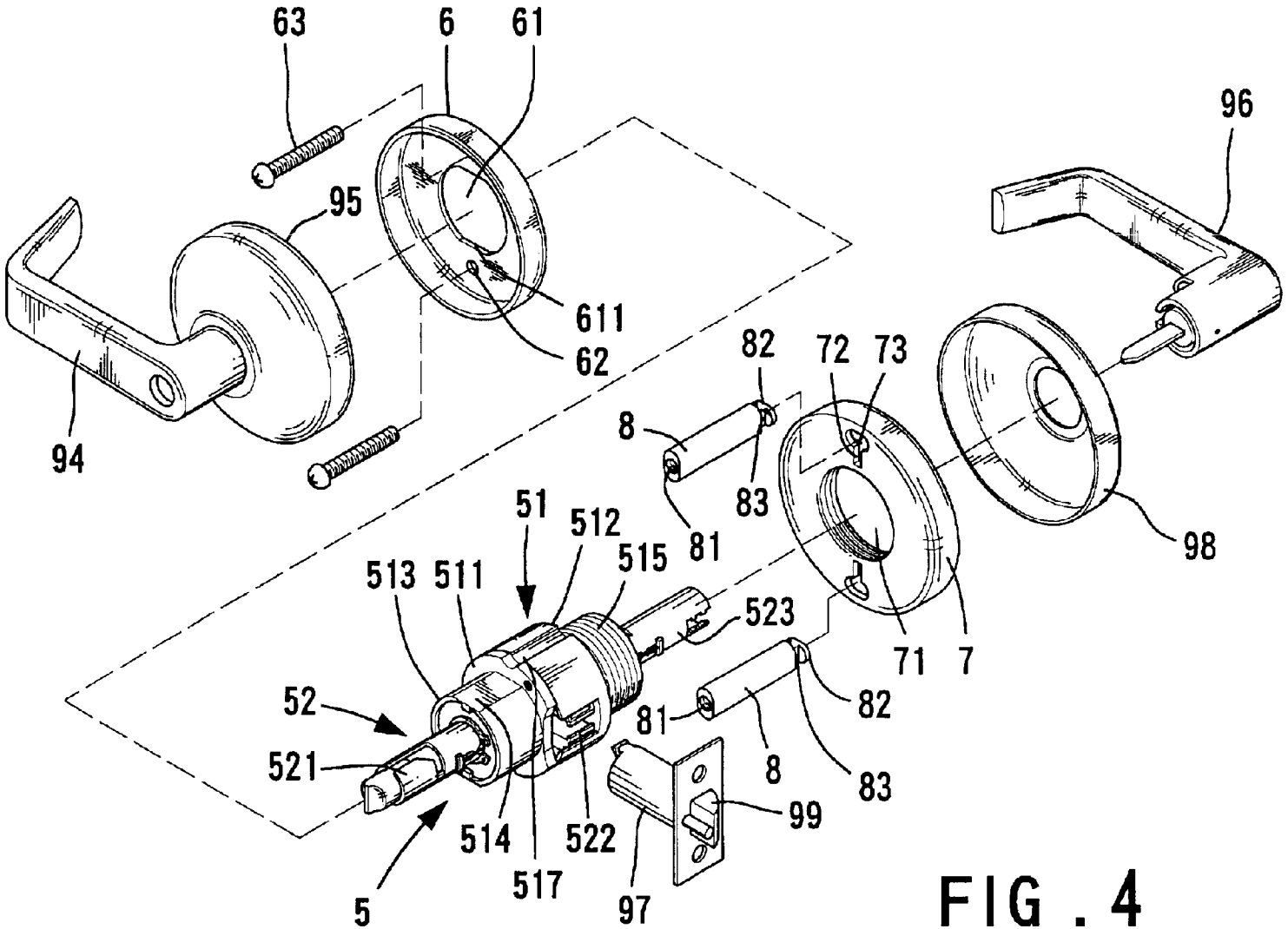
FIG. 4 is an exploded perspective view of the cylindrical lock in accordance with the present invention.

Referring to FIG. 4, a cylindrical lock in accordance with the present invention generally comprises a lock main body 5 mounted in a mounting hole 91 of a door 9, an inside rose liner 6, an outside rose liner 7, and two mounting rods 8. The lock main body 5 includes a substantially cylindrical hub 51 including an inside hub 511 and an outside hub 512. A transmission assembly 52 is mounted in the hub 51 and includes an inside spindle 521, an outside spindle 523, and a retractor 522. The inside hub 511 includes a sleeve portion 513 with two diametrically opposed chamfered faces 514. The outside hub 512 includes a sleeve portion 515 with an outside threading.

The inside rose liner 6 is mounted around the sleeve portion 513 of the inside hub 511 and has a central hole 61 with two diametrically opposed rectilinear sections 611 for engaging with the chamfered faces 514 of the inside hub 511, thereby preventing undesired rotation of the inside rose liner 6 relative to the sleeve portion 513 of the inside hub 511. The outside rose liner 7 is mounted around the sleeve portion 515 of the outside hub 512 and has an inner threading 71 for threadedly engaging with the outer threading of the sleeve portion 515 of the outside hub 512.

The cylindrical lock further includes a latch mechanism 97 attached to the lock main body 51, an inside rose 95, an outside rose 98, an inside handle 94 (a lever type handle in this embodiment), and an outside handle 96 (a lever type handle in this embodiment). The latch mechanism 97 includes a latch 99 operably connected to the retractor 522 mounted in the lock main body 5. The latch 99 is retracted when the retractor 522 is actuated by turning either the inside handle 94 or the outside handle 96. The inside rose 95 covers the inside rose liner 6 and abuts against an inner side of the door 9. The outside rose 98 covers the outside rose liner 7 and abuts against an outer side of the door 9. The inside handle 94 has an end connected to the inside spindle 521 to turn therewith. The outside handle 96 has an end connected to the outside spindle 523 to turn therewith. Turning of either handle 94, 96 causes movement of the retractor 522, which, in turn, retracts the latch 99 to thereby allow opening of the door 9.

Of more importance, the hub 51 includes two recessed portions 517 extending along an axial direction of the hub 51 for receiving and thus positioning at least a portion of an associated one of the mounting rods 8. The outside rose liner 7 includes two diametrically disposed engaging slots 72 each having an enlarged section 73. Each mounting rod 8 includes a screw hole 81 in a first end thereof and a cutout 83 in a second end thereof, leaving an end piece 82 on the second end of the mounting rod 8. The cutout 83 of each mounting rod 8 is sized to receive a thickness of the outside rose liner 7. The inside rose liner 6 includes two diametrically opposed holes 62. The end piece 82 of each mounting rod 8 is inserted into the enlarged section 73 of the respective engaging slot 72 of the outside rose liner 7 and then slid into the reduced portion of the respective engaging slot 72. Thus, the second end of each mounting rod 8 is attached to the outside rose liner 7, and disengagement of the mounting rod 8 is avoided unless the mounting rod 8 is moved to the enlarged section 73 of the respective engaging slot 72 of the outside rose liner 7.

Figure 1:
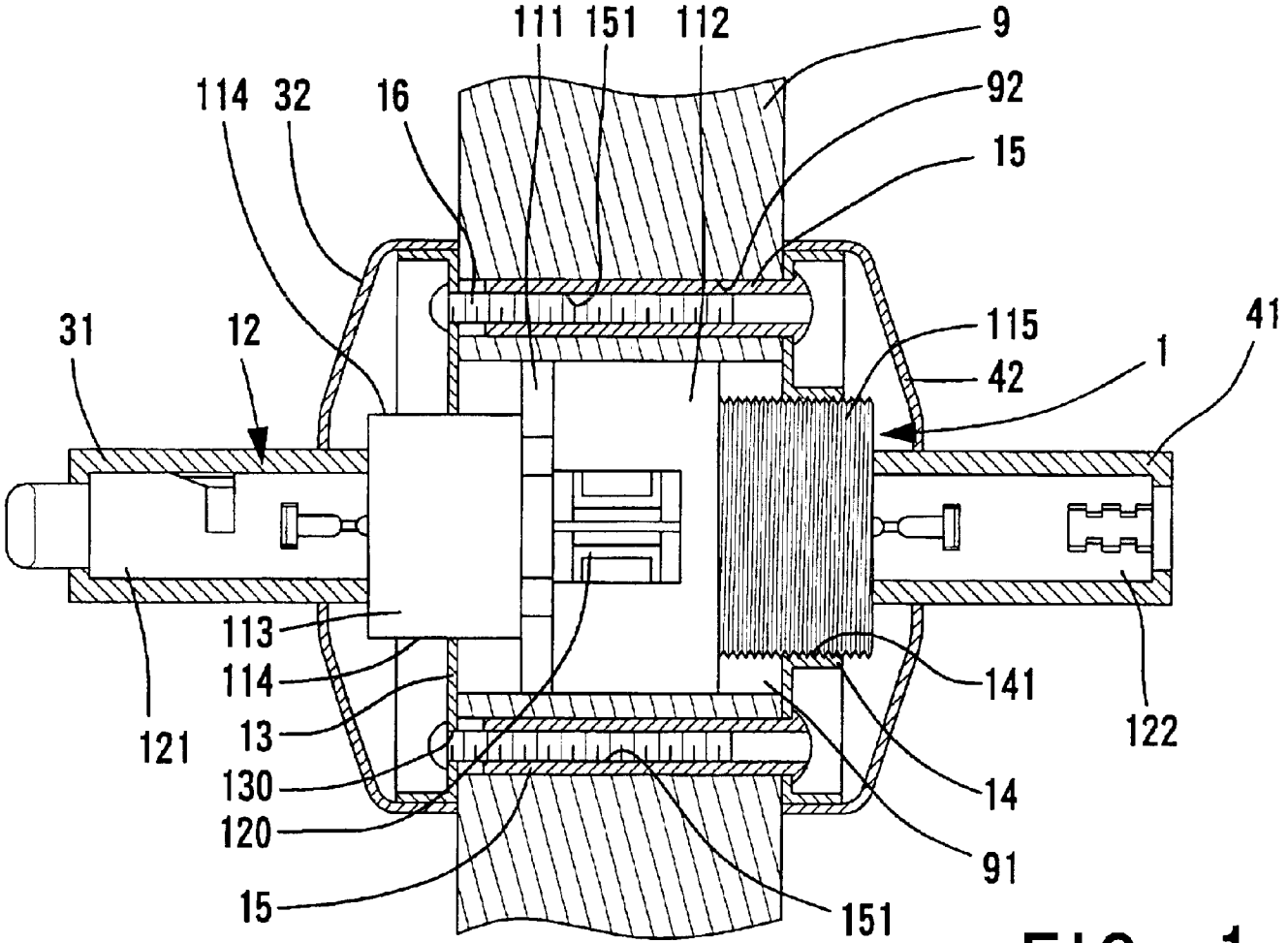
FIG. 1 PRIOR ART
FIG. 1 is a sectional view of a door and a conventional cylindrical lock.
Figure 2:
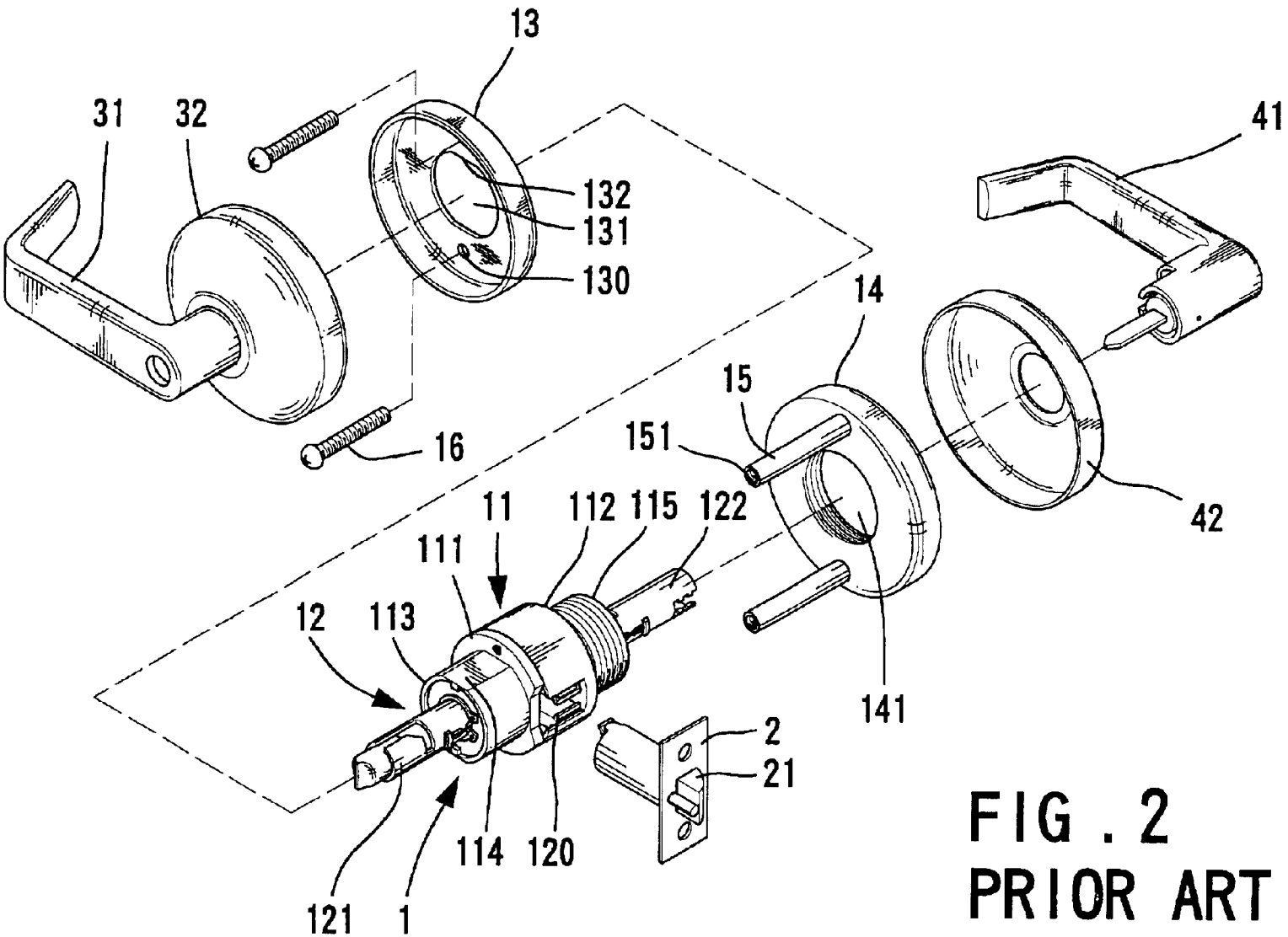
FIG. 2 PRIOR ART
FIG. 2 is an exploded perspective view of the conventional cylindrical lock in FIG. 1.
Figure 3:
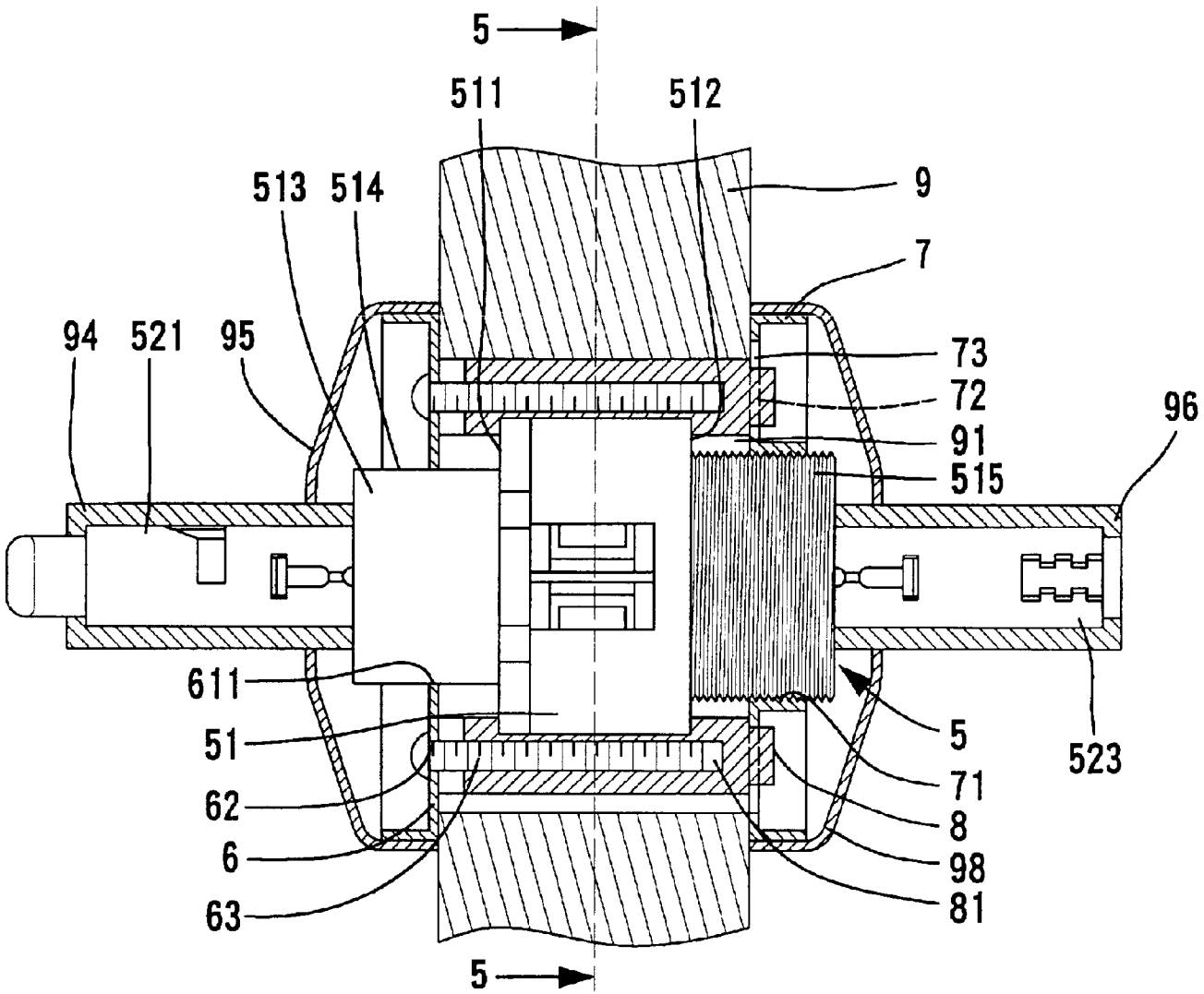
FIG. 3 is a sectional view of a door and a cylindrical lock in accordance with the present invention.
Figure 5:
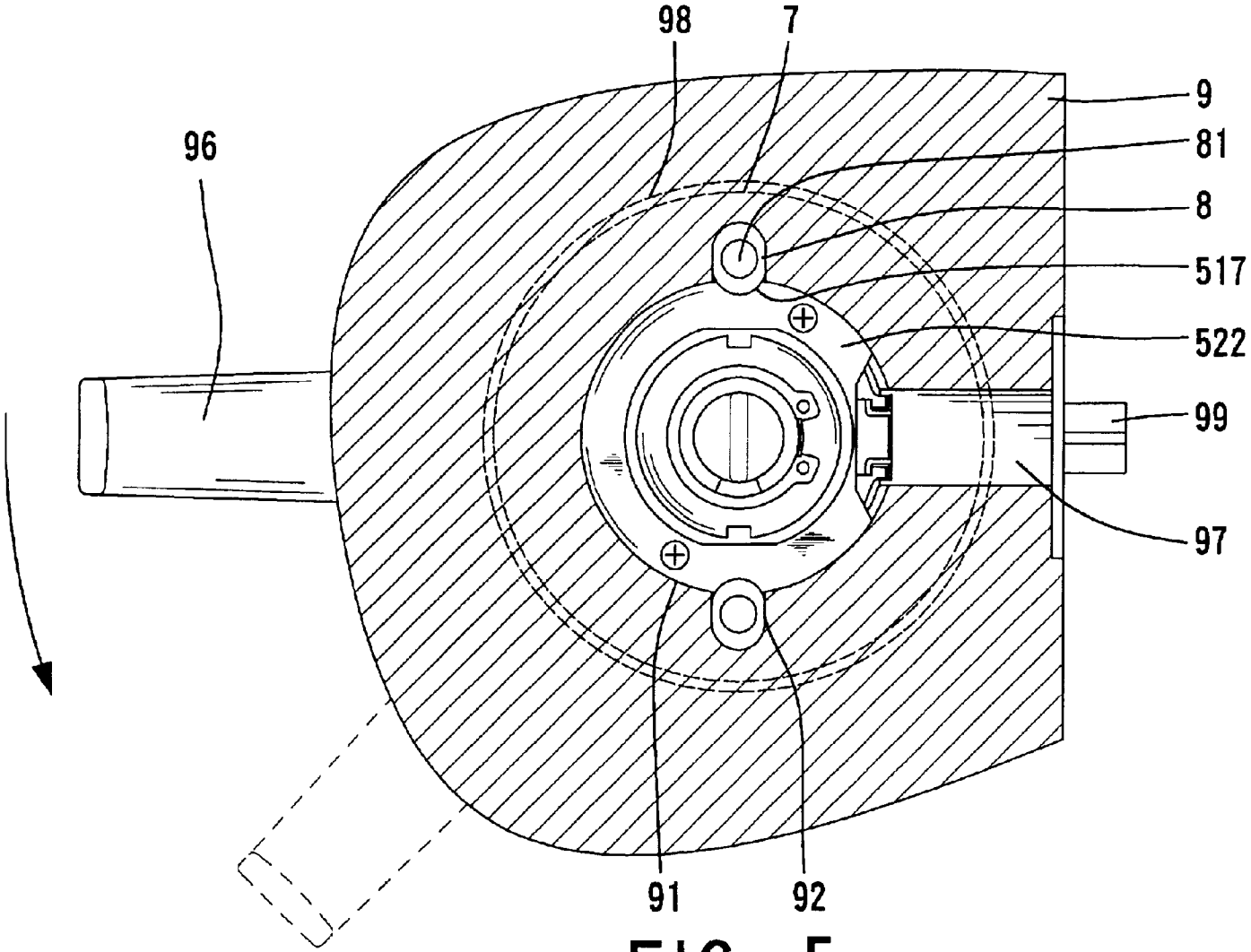
FIG. 5 is a sectional view taken along plane 5—5 in FIG. 3.

In assembly, as illustrated in FIGS. 3 and 5, the outside rose liner 7 can be turned and thus move along an axial direction via threading engagement between the outer threading of the sleeve portion 515 of the outside hub 512 and the inner threading 71 of the outside rose liner 7 until the lock main body 5 reaches a desired position in the mounting hole 91 corresponding to the thickness of the door 9. Thus, the retractor 522 is aligned with a tail portion of the latch 99.

Figure 6:
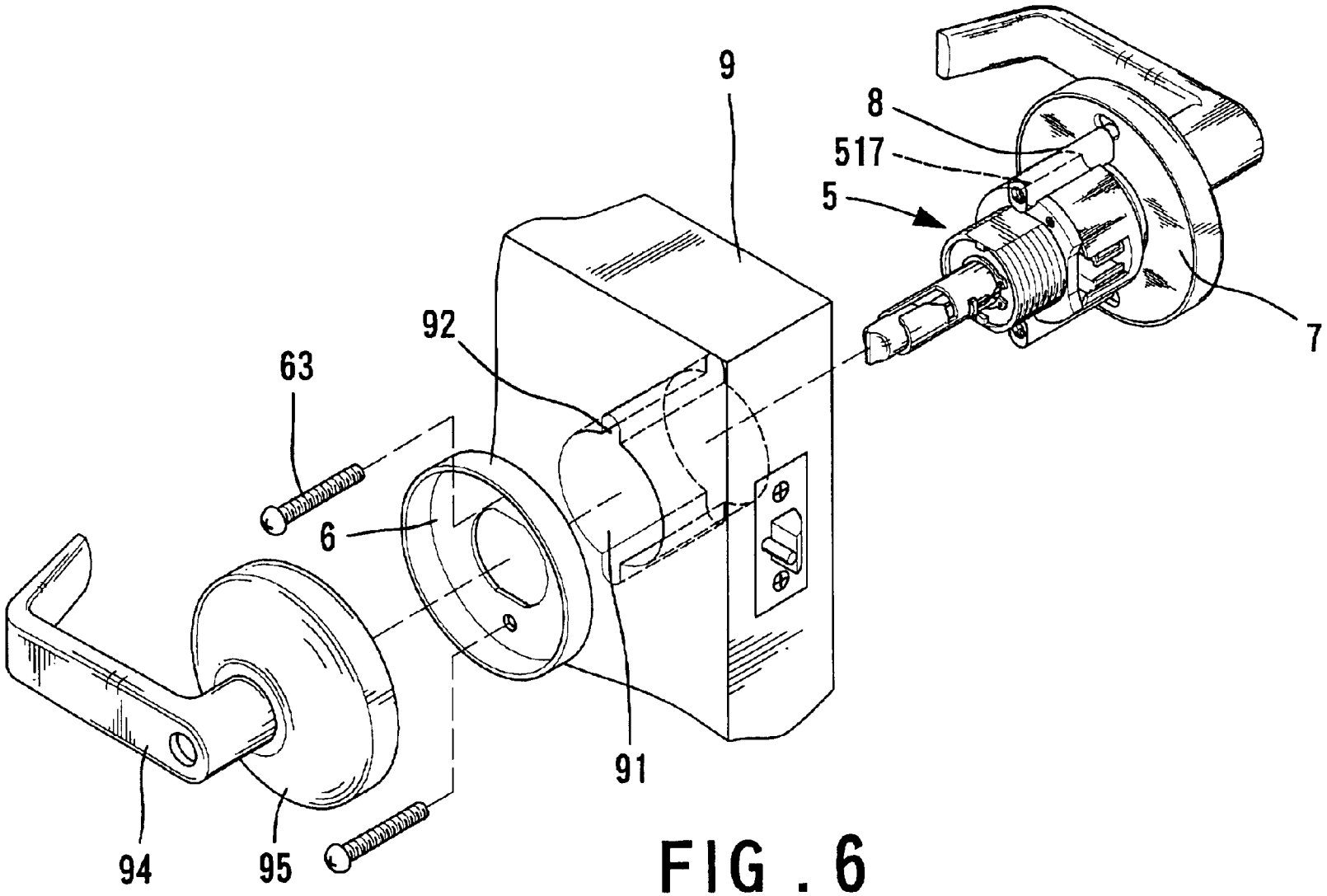
FIG. 6 is an exploded perspective view of a door and the cylindrical lock in accordance with the present invention.

As illustrated in FIG. 6, the mounting hole 91 of the door 9 includes two diametrically disposed positioning grooves 92 defined in an inner periphery defining the mounting hole 91. Each mounting rod 8 is partially located in a respective positioning groove 92. Next, two bolts 63 are respectively extended through the holes 62 of the inside rose liner 6 and the screw holes 81 of the mounting rods 8 attached to the outside rose liner 7, thereby securing the lock main body 5 to the door 9.

The positioning mechanism provided by the cylindrical lock in accordance with the present invention includes the central hole 611 of the inside rose liner 6 and the sleeve portion 513 of the lock main body 5 that cannot be turned relative to the inside rose liner 6. This provides a certain resistance to torque resulting from turning of either handle 94, 96. The mounting rods 8 positioned in the positioning grooves 92 and in the recessed portions 517 of the hub 51 provides another positioning mechanism that increases resistance to torque resulting from turning of either handle 94, 96. Namely, the lock main body 5 is positioned by the inside rose liner 6, the outside rose liner 7, and the hub 51, which greatly increases the resistance to torque resulting from, e.g., turning of either handle 94, 96. Preferably, each recessed portion 517 of the hub 51 is sized to receive a width of the associated mounting rod 8.

The mounting rods 8 can be detached from the outside rose liner 7 for easy engagement with the recessed portions 517 of the hub 51 while allowing threading engagement with the bolts 63. Further, the outside rose liner 7 can be adjusted before installation of the lock main body 5. Further, the procedure of fixing the mounting rods 15 on the outside rose liner 14 of the conventional design is eliminated, which reduces the cost.

Although the invention has been explained in relation to its preferred embodiment, it is to be understood that many other possible modifications and variations can be made without departing from the scope of the invention as hereinafter claimed.

What is claimed is:

1. A cylindrical lock comprising:

a lock main body adapted to be mounted in a mounting hole of a door, the lock main body including a hub having an inside hub end an outside hub, the hub including two diametrically disposed recessed portions extending along an axial direction of the hub;

an inside rose liner securely mounted around the inside hub, the inside rose liner including two holes;

an outside rose liner including a central hole in threading engagement with the outside hub, the outside rose liner including two engaging slots aligned with the holes of the inside rose liner; and two mounting rods each including a first end with a screw hole and a second end engaged in an associated one of the engaging slots of the outside rose liner, the mounting rods being respectively, only partially received and positioned in the recessed portions of the hub, and each said mounting rod being adapted to be only partially received and positioned in an associated one of two positioning grooves in the door to which the cylindrical lock is mounted.

2. The cylindrical lock as claimed in claim 1, wherein each said engaging slot of the outside rose liner includes an enlarged section for allowing insertion of the second end of an associated one of the mounting rods.

3. The cylindrical lock as claimed an claim 2, wherein the second end of each said mounting rod includes a cutout to form an end piece the cutout of each said mounting rod being sized to fittingly receive a thickness of the outside ruse liner.

4. The cylindrical lock as claimed in claim 1, wherein each said recessed portion of the hub is sized to fittingly receive a width of an associated one of the mounting rods.

5. A cylindrical lock comprising:

a lock main body mounted in a mounting hole of a door, the lock main body including a hub having an inside hub and an outside hub, the hub including two diametrically disposed recessed portions extending along an axial direction of the hub;

an inside rose liner securely mounted around the inside hub, the inside rose liner including two holes;

an outside rose liner including a central hole in threading engagement with the outside hub, the outside rose liner including two engaging slots aligned with the holes of the inside rose liner, and two mounting rods each including a first end with a screw hole and a second end engaged in an associated one of the engaging slots of the outside rose liner, the mounting rods being respectively, only partially received and positioned in the recessed portions of the hub, and each said mounting rod being only partially received and positioned in an associated one of two positioning grooves in the door to which the cylindrical lock is mounted.

6. The cylindrical lock as claimed in claim 5, wherein each said engaging slot of the outside rose liner includes an enlarged section for allowing insertion of the second end of an associated one of the mounting rods.

7. The cylindrical lock as claimed in claim 6, wherein the second end of each said mounting rod includes a cutout to form an end piece, the cutout of each said mounting rod being sized to fittingly receive a thickness of the outside rose liner.

8. The cylindrical lock as claimed in claim 5, wherein each said recessed portion of the hub is sized to fittingly receive a width of an associated one of the mounting rods.

9. A cylindrical lock comprising:

a lock main body mounted in a mounting hole of a door, the lock main body including a hub having an inside hub and an outside hub, the hub including an outer periphery, the hub further including two diametrically disposed recessed portions extending along an axial direction of the hub and extending inward of the outer periphery of the hub;

an inside rose liner securely mounted around the inside hub, the inside rose liner including two holes;

an outside rose liner including a central hole in threading engagement with the outside hub, the outside rose liner including two engaging slots aligned with the holes of the inside rose liner; and two mounting rods each including a first end with a screw hole and a second end engaged in an associated one of the engaging slots of the outside rose liner, the mounting rods being respectively, only partially received and positioned in the recessed portions of the hub, and each said mounting rod extending beyond the outer periphery of the hub and being only partially received and positioned in an associated one of two positioning grooves in the door to which the cylindrical lock is mounted.

10. The cylindrical lock as claimed in claim 9, wherein each said engaging slot of the outside rose liner includes an enlarged section for allowing insertion of the second end of an associated one of the mounting rods.

11. The cylindrical lock as claimed in claim 10, wherein the second end of each said mounting rod includes a cutout to form an end piece, the cutout of each said mounting rod being sized to fittingly receive a thickness of the outside rose liner.

12. The cylindrical lock as claimed in claim 9, wherein each said recessed portion of the hub is sized to fittingly receive a width of an associated one of the mounting rods.

* * * * *